United States Patent [19]

Kelling

[11] 4,093,229

[45] June 6, 1978

[54] GAME TRACING ARROW

[75] Inventor: Richard C. Kelling, Grafton, Wis.

[73] Assignee: The Raymond Lee Organization, Inc., New York, N.Y. ; a part interest

[21] Appl. No.: 829,608

[22] Filed: Sep. 1, 1977

[51] Int. Cl.[2] ..... F41B 5/02

[52] U.S. Cl. ..... 273/106.5 R

[58] Field of Search ..... 273/106.5 R, 106.5 B, 273/106.5 D, 95 R; 102/92.7; 43/6

[56] References Cited

U.S. PATENT DOCUMENTS

| | | | |
|---|---|---|---|
| 3,150,875 | 9/1964 | Searles | 273/106.5 R |
| 3,419,274 | 12/1968 | Tabor | 273/106.5 R |
| 3,429,263 | 2/1969 | Snyder et al. | 102/92.7 |
| 3,528,662 | 9/1970 | Merchant et al. | 273/106.5 R |
| 3,649,020 | 3/1972 | Hall | 102/92.7 X |
| 3,701,533 | 10/1972 | Palmer | 273/106.5 R |
| 3,983,817 | 10/1976 | Tucker | 102/92.7 X |

*Primary Examiner*—Paul E. Shapiro

*Attorney, Agent, or Firm*—Daniel Jay Tick

[57] ABSTRACT

A hollow arrow shaft is open at a first end, and is filled in, so that it is solid in the area of its opposite second end for a predetermined part of its length from its second end. Holes are formed through the shaft where such shaft is hollow, next-adjacent the solid part of the shaft. A trail-indicating dye material is provided in the shaft. Feathers are affixed to the shaft extending from the area of the second end thereof where the shaft is solid. A piston member is coaxially movably mounted in the shaft at the first end thereof and extends a predetermined distance out of the fist end and a predetermined distance into the shaft. A head part is mounted on the piston member at the end thereof extending from the first end of the shaft. Thus, when the arrow strikes a target, the impact with the target forces the piston member back into the shaft thereby causing the dye material to gradually drip to the ground via the holes through the shaft to mark the trail of the target.

2 Claims, 4 Drawing Figures

GAME TRACING ARROW

BACKGROUND OF THE INVENTION

The present invention relates to a game tracing arrow. More particularly, the invention relates to a game tracing arrow for providing a trail for game struck by the arrow.

Objects of the invention are to provide a game tracing arrow of simple structure, which is inexpensive in manufacture, used with facility and convenience, and functions efficiently, effectively and reliably to provide a trail for game struck by the arrow.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
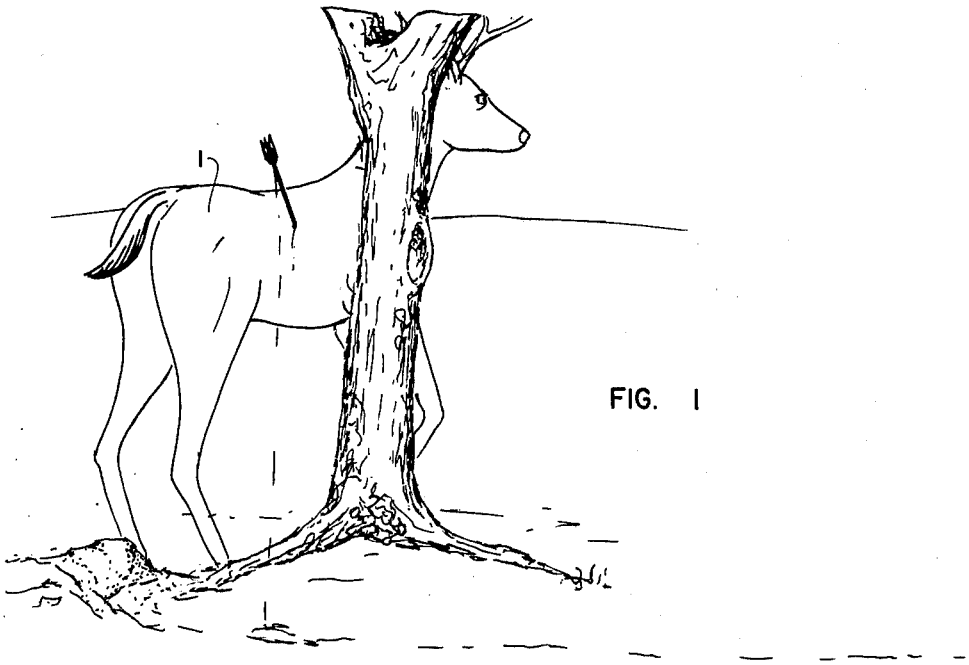
FIG. 1 is a view of an embodiment of the game tracing arrow of the invention embedded in a target.

The game tracing arrow of the invention provides a trail for game such as, for example, a deer 1, shown in FIG. 1, struck by the arrow.

Figure 2:
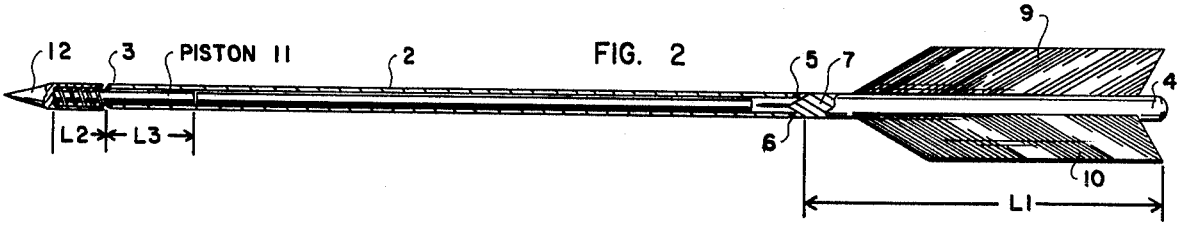
FIG. 2 is a view, on an enlarged scale, partly cut away and partly in section, of the embodiment of FIG. 1, prior to impact with a target.
Figure 3:
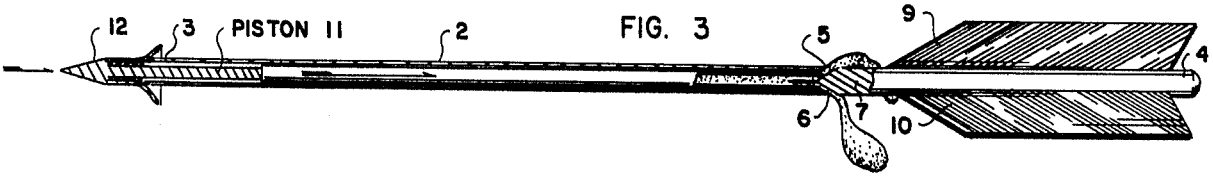
FIG. 3 is a view, on an enlarged scale, partly cut away and partly in section, of the embodiment of FIG. 1, after impact with a target.

The game tracing arrow of the invention comprises, as shown in FIGS. 2 and 3, a hollow shaft 2 having spaced opposite first and second ends 3 and 4, respectively. The shaft 2 opens at its first end 3 and is filled in so that it is solid in the area of its second end 4, as shown in FIGS. 2 and 3, for a predetermined part L1 of the length from said second end (FIG. 2).

Figure 4:
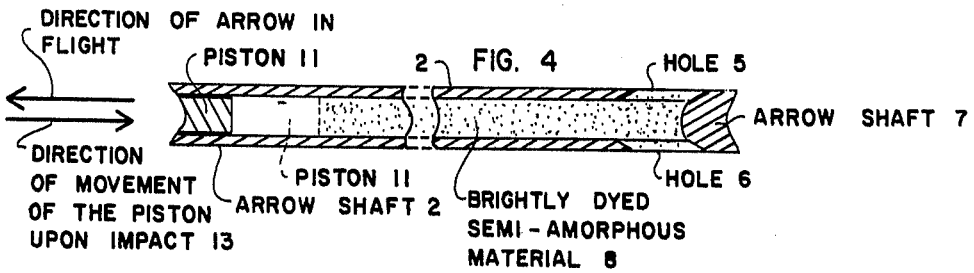
FIG. 4 is a cross-sectional view, on an enlarged scale, of part of the embodiment of FIGS. 2 and 3.

The shaft 2 has a plurality of equiangularly spaced holes formed therethrough around the circumference thereof where said shaft is hollow, but next-adjacent the solid part thereof. In the views of FIGS. 2 to 4, two of the holes 5 and 6, which are diametrically opposite each other, are shown. As shown in FIGS. 2 to 4, the holes 5 and 6 are formed through the shaft around the circumference thereof where said shaft is hollow, but next-adjacent the solid part 7 of said shaft.

A trail-indicating dye material 8 is provided in the hollow shaft 2, as shown in FIG. 4. The dye material is preferably non-toxic and is brightly colored so that it leaves a clear trail. The material 8 is preferably semi-amorphous, so that it seeps through the holes 5, 6, and so on, rather than pouring through rapidly.

As shown in FIGS. 2 and 3, feathers 9, 10, and so on, are affixed to the shaft 2 and extend from the area of the second end 4 of the shaft where said shaft is solid.

A piston member 11 (FIGS. 2 to 4) is coaxially movably mounted in the shaft 2 at the first end 3 thereof and extends a predetermined distance L2 out of said first end (FIG. 2) and a predetermined distance L3 into said shaft (FIG. 2).

A head part 12, which may comprise an arrowhead or cutting point, or the like, is mounted on the piston member 11, as shown in FIGS. 2 and 3, at the end of said piston member extending out of the first end 3 of the shaft 2.

When the arrow strikes a target, such as, for example, the target 1 of FIG. 1, the impact with the target forces the piston member 11 back into the shaft 2 in the direction of the arrow 13 of FIG. 4, thereby causing the dye material 8 to gradually drip to the ground through the shaft 2 to mark the trail of the target.

While the invention has been described by means of a specific example and in a specific embodiment, I do not wish to be limited thereto, for obvious modifications will occur to those skilled in the art without departing from the spirit and scope of the invention.

Arrows of the type described in the present application are disclosed in the following U.S. Patents: U.S. Pat. No. 2,923,243, issued to Crockford et al on Feb. 2, 1960, U.S. Pat. No. 3,150,875, issued to Searles on Sept. 20, 1964, U.S. Pat. No. 3,207,157, issued to Murdoch on Sept. 21, 1965, U.S. Pat. No. 3,393,912, issued to DeLonais on July 23, 1968; U.S. Pat No. 3,417,994, issued to Rohrbaugh, Jr. on Dec. 24, 1968, U.S. Pat. No. 3,528,662, issued to Merchant et al on Sept. 15, 1970, U.S. Pat. No. 3,565,435, issued to Bear on Feb. 23, 1971, U.S. Pat. No. 3,701,533, issued to Palmer on Oct. 31, 1972, U.S. Pat. No. 3,865,374, issued to Troncoso on Feb. 11, 1975, U.S. Pat. No. 3,893,866, issued to Hollingsworth on July 8, 1975 and U.S. Pat. No. 3,993,311, issued to Johnson on Nov. 23, 1976.

I claim:

1. A game tracing arrow for providing a trail for game struck by the arrow, said game tracing arrow comprising a hollow shaft having spaced opposite first and second ends, said shaft opening at its first end and being filled in so that it is solid in the area of its second end for a predetermined part of the length from said second end, said shaft having equiangularly spaced holes formed therethrough around the circumference thereof where said shaft is hollow but next-adjacent the solid part thereof;

a trail-indicating dye material in the shaft;

feathers on the shaft extending from the area of the second end thereof where said shaft is solid;

a piston member coaxially movably mounted in the shaft at the first end thereof and extending a predetermined distance out of said first end and a predetermined distance into said shaft; and a head part on the piston member at the end thereof extending out of the first end of the shaft whereby when the arrow strikes a target the impact with the target forces the piston member back into the shaft thereby causing the dye material to gradually drip to the ground via the holes through the shaft to mark the trail of the target.

2. A game tracing arrow as claimed in claim 1, wherein the dye material consists of a brightly dyed semi-amorphous material.

* * * * *